US007159835B2

(12) United States Patent
Srackangast

(10) Patent No.: US 7,159,835 B2
(45) Date of Patent: Jan. 9, 2007

(54) MAGNETIC HOLE FORMER

(75) Inventor: James V. Srackangast, Harrisburg, NC (US)

(73) Assignee: Tru-Contour, Inc., Harrisburg, NC (US)

( * ) Notice: Subject to any disclaimer, the term of this patent is extended or adjusted under 35 U.S.C. 154(b) by 137 days.

(21) Appl. No.: 10/772,559

(22) Filed: Feb. 5, 2004

(65) Prior Publication Data

US 2005/0173612 A1 Aug. 11, 2005

(51) Int. Cl.
*B28B 7/28* (2006.01)

(52) U.S. Cl. ..... 249/142; 249/177; 425/DIG. 33

(58) Field of Classification Search ..... 249/39, 249/142, 177, 205; 425/3, DIG. 33
See application file for complete search history.

(56) References Cited

U.S. PATENT DOCUMENTS 3,686,815 A 8/1972 Von Bose
3,786,386 A 1/1974 Braillon
4,379,277 A 4/1983 Philibert
5,356,534 A 10/1994 Zimmerman et al.
6,110,402 A * 8/2000 Miller ..... 264/31
6,196,517 B1 3/2001 Westhoff et al.
6,371,436 B1 4/2002 Westhoff et al.
6,454,686 B1 9/2002 McEachern
6,575,424 B1 6/2003 Domizio
2003/0047664 A1 3/2003 DeFiglio

* cited by examiner

*Primary Examiner*—Donald Heckenberg
(74) *Attorney, Agent, or Firm*—Clements Walker

(57) ABSTRACT

An improved method and apparatus for attaching a hole former to a mold assembly for use in the formation of cast materials such as concrete and the like. The apparatus comprises a hole former assembly attached to a bracket. The bracket is held in a stationary position by a magnet assembly that is remotely located from the hole former. The magnet assembly is comprised of a plurality of magnets encased in a metal casing. An expendable blister pack can be provided to fit on the outside of the casing to facilitate removal of the magnetic assembly from the cast member.

9 Claims, 3 Drawing Sheets

Fig.3
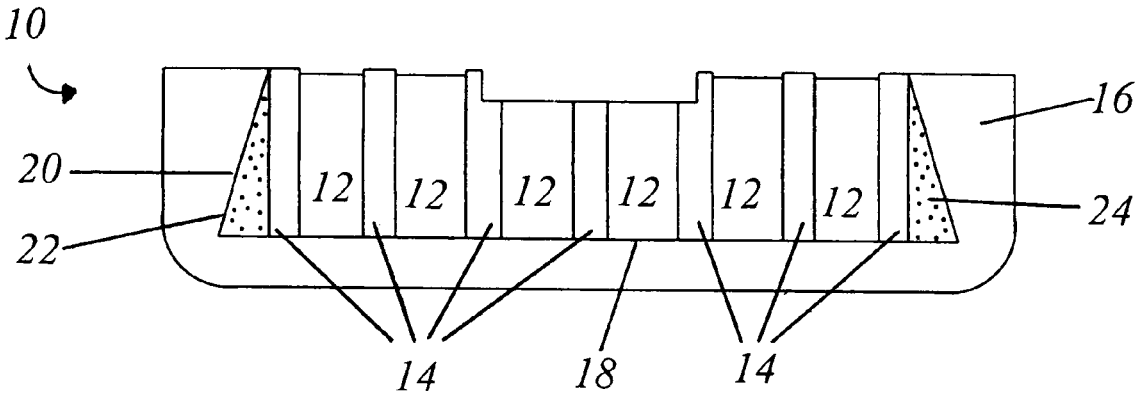
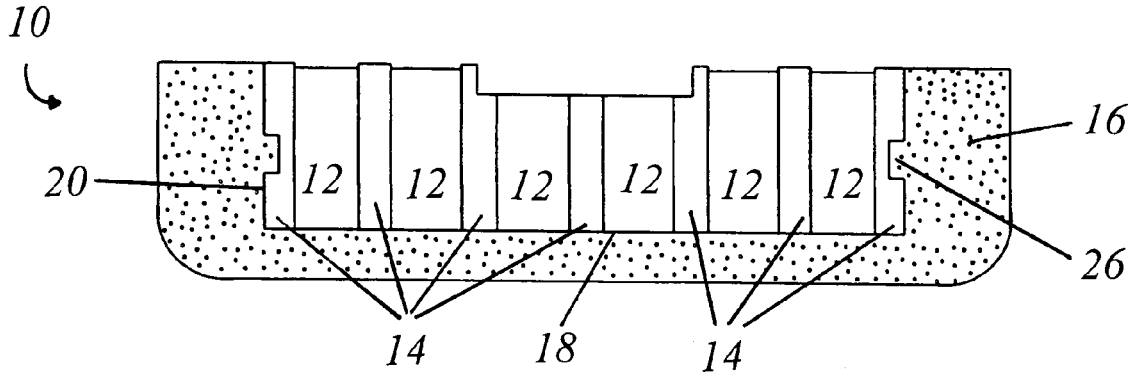
Fig.4

MAGNETIC HOLE FORMER

FIELD OF THE INVENTION

The present invention relates to cast members having holes formed therein. More particularly, the present invention relates to apparatuses and methods for accurately positioning and retaining a hole former or mandrel in a desired position during the casting process.

BACKGROUND OF THE INVENTION

Hole formers, knock-out molds, and mandrels are well known in concrete casting, being utilized to accurately define and position an opening within a cast concrete structure, such as a manhole casting or drainage box. Pipes can then be mortared into the openings created by the hole formers and mandrels. Typical cast members are buried underground at depths reaching 30 feet. At these depths, accurate hole placement within the cast member becomes crucial in order to avoid costly retrenching and realignment of pipes with the cast member.

Traditionally, hole formers, mandrels and knock-out molds have been positioned in a concrete casting utilizing one of two methods. When casting the concrete, the hole former, mandrel or knock-out mold (collectively referred to as "hole formers" hereinafter) is placed so that the hole former's end cap is adjacent to at least one wall of the mold form. The first method calls for the hole former to then be attached to the mold form by drilling holes through the end cap of the hole former, into the mold form. A wire is then passed through the corresponding holes in order to attach the hole former to the inner mold and hold the hole former in place during the casting process.

However, different concrete forms often require holes in very different locations. This results in a myriad of holes that have to be drilled into the inner mold in order to accommodate and accurately place a hole in the concrete casting. This excessive drilling weakens the structural stability of the inner mold, which can result in chipped edges around unused holes. Additionally, the excess holes that are not being utilized to position a hole former become repositories for casting material, which makes removal of the casting from the inner mold more difficult. This can easily result in damaged and broken castings, thus increasing production time and costs.

Moreover, hole formers have a tendency to float in the casting medium. Wires that are used to attach the hole former to the inner mold often allow a shifting of the hole former, so that the final placement of the hole in the casting does not correspond with the precast placement. Holes in the casting therefore do not accurately align with the pipes to be attached.

The second method, of attachment involves utilizing a removable hanger that attaches to the top of the mold form. While this arrangement does not damage the mold form in ways similar to the use of bailing wire described above, it does suffer similar drawbacks in the shifting of the hole former during the casting process.

During the casting process, the mold form is often vibrated to remove air pockets from the cast material. This vibration often has the unfortunate effect of shifting the hole former from its desired location. While traditional hangers may retain the vertical alignment of the hole former during this vibration, horizontal or radial movement of the hole former is not as easily controlled.

Some manufacturers have tried to overcome the use of the hanging apparatus by securing the hole former in place with a centrally situated magnet. These devices also overcome problem of damaging the mold form, but are still subject to shifting of the hole former due to the combined buoyant and vibrational forces that are present during the casting process. This problem is compounded when the magnet is to be used with a manhole casting, where the mold form has a radial surface. The planar surface of the magnets centrally disposed in the hole former are not able to fully engage the radial surface of the manhole casting, resulting in a weakened attraction between the magnet and the mold form. Without experiencing the full force of the magnets, hole formers are much more easily displaced from their desired position during the casting process.

It would therefore be desirable to be able to accurately place and secure a hole former during the casting process that would not degrade the integrity of the mold form. Additionally, it would be beneficial to securely maintain the placement of the hole former during the casting process, overcoming any buoyant forces that may displace the hole former from its intended positioning. Finally, it would be beneficial to have a means of securing a hole former that would work equally well on both flat and radial surfaces.

DESCRIPTION OF THE PRIOR ART

U.S. Pat. No. 3,686,815 issued to Von Bose discloses a method of building wall sections of a habitable structure utilizing two wall panels and a foamed core. Removable construction forms back up and support the wall panels during formation. The construction forms have a sheet of magnetizable material contacting the outer surface of the wall panels. Various fixtures, such as window and door frames, electrical outlets and the like can then be magnetically attached to the wall panels to be held in place for the remainder of the construction process. The space between the wall panels that is not occupied by the fixtures is then filled with a foamed in situ, synthetic, polymeric composition. The magnetic fixtures prevent the filling of the fixture voids. Once the foam solidifies, the wall panels are removed, leaving the completed wall section.

U.S. Pat. No. 3,786,386 issued to Cardone et al. concerns a magnetic device for use in printing systems whereby plates, cliches and the like are anchored to a ferro-magnetic support base. The invention also contemplates a specific magnet-positioning scheme, since apparently prior solutions that utilized this idea did not have the anchoring power to overcome the stresses acting on the plate during the printing process. Therefore, the plates would shift. The new magnet consists of a ferromagnetic support having slots. The slots are lined at the bottom with a non-magnetic metal such as aluminum, and then a permanent magnet battery is placed therein. This structure is then sealed with an epoxy resin. The permanent magnet battery can include a multiple magnet system.

U.S. Pat. No. 4,379,277 issued to Braillon teaches a magnetic chuck for the holding of a magnetically attractable work piece to a worktable or other support for a machine tool. The Braillon chuck creates a magnetic field on the lateral sides of the chuck, and not just the upper surface, as prior chucks have done. The chuck can be manually switched between an "on" state and an "off" state. In the "on" configuration, a series of alternating magnets in a first series on the chuck surface align with a second alternating series of magnets in a north-north/ south-south arrangement, so as to create a strong additive magnetic force on the surface of the chuck. When switched to the "off" configuration, the second magnet series slides so as to align itself with the first magnet series in a north-south/ north-south arrangement. This has the effect of canceling out the magnetic force that is experienced on the surface of the chuck so that the work piece can be easily maneuvered. The chuck contains a multiple magnet system so as to increase the attractive forces between it and the work piece.

U.S. Pat. No. 5,356,534 issued to Zimmerman discloses a magnetic-field amplifier that produces a composite magnetic field that may be used to treat fluids flowing in a conduit, or to provide an increased magnetic field to the armature of a motor, generator, or other magnetically operated device. The magnetic assembly is comprised of an inner magnetic structure containing 3 permanent magnets, a first and second ferromagnetic pole, a ferromagnetic cover, and a first and second non-magnetic insulating rod. A multiple magnet structure is used to increase the field strength applied to the conduit. Water flowing through the magnetic field causes a current to be generated that maintains the fluid flow in the conduit at a positive static charge. This positive charge helps to keep dissolved particles from precipitating out of solution and forming scale on the inside of the pipe.

U.S. Pat. No. 6,110,402 issued to Miller is directed to magnetically attachable hole forms which can be used in processes for casting manholes and related structures with holes or openings therein. The hole form is provided with a step through bore that is capable of receiving a magnet assembly which holds the hole form in place when it is placed on a wall surface of the casting mold. The face of the magnet should be contoured to match the surface of the wall form to which it is attached. The magnet assembly is provided with a threaded through-bore into which a bolt is placed in order to break the magnet assembly and the wall form.

U.S. Pat. No. 6,196,517 and its related divisional U.S. Pat. No. 6,371,436, both issued to Westhoff et al., describe a describes a two-piece ring placement assembly that is used in hole formation. The ring assembly is held to the core member of the mold assembly by a magnet that that can be mechanically released once the cast material has set. The magnet assembly is comprised of an interchangeable permanent magnet with a mounting plate that has a mechanical release mechanism thereon that functions similarly to the release mechanism described in the Miller '402 patent. The ring assembly is provided with knockout pads that ease the separation of the two pieces should they become adhered together in the casting process. The invention also discloses a one-piece hole former with a similar magnet assembly.

U.S. Pat. No. 6,454,686 issued to McEachem is directed to a magnetic cylinder or drum for use in holding printing plates, embossing plates, and the like. The cylinder is provided with offset recesses in to the cylinder for the receiving of magnet assemblies. The use of multiple magnets inserted into the various recesses is disclosed.

U.S. Pat. No. 6,575,424 issued to Domizio discloses void forming device for use with concrete casting molds. The device consists of a resilient member with a lifting member contained therein. The resilient member is anchored to the wall of the casting mold by way of a mounting structure. The patent discloses securing the mounting structure to the casting wall utilizing magnetic fasteners. The resilient member creates a recess into the cast material, such that the lifting member extends from the recess into the cast material. Once the cast material has hardened, the mounting structure and the resilient member are removed, leaving the lifting member embedded in the cast recess previously occupied by the resilient member.

U.S. Pat. Application publication No. US 2003/0047664 discloses a sleeve holder cast into a wall type structure through which conduits and wires can be run. The apparatus is comprised of a flexible plastic material so as to permit the sleeve holder to conform to nonvertical and nonparallel sidewalls of the cast mold. A sleeve extends from one of such sleeve holders on the first wall of the cast mold, to a second sleeve holder mounted on the second wall of the cast mold. The invention also discloses that the sleeve holders can be mounted on the inner wall surface of ferrous molds using magnets. The magnets can be molded within the flange, or can be located on the outer surface of the flange.

OBJECTS OF THE INVENTION

It is one object of the present invention to provide a novel means of attaching a mandrel unit to a mold assembly in a manner that prevents buoyancy, vibration, and other forces from dislocating the mandrel unit from its desired placement during the curing process.

It is another object of the present invention to provide a novel means for attaching a mandrel, hole former, or knock-out unit to a mold assembly, utilizing a hanging bracket that secures the hole former to a remote portion of the mold assembly, outside the area filled with casting material.

Still another object of the present invention is to provide a novel means for attaching a bracket to the mold assembly at a location remote from the cast material, utilizing a magnetic force to attach the bracket to the mold assembly.

Still another object of the present invention is to provide a method of attaching a mandrel unit to a mold assembly utilizing a magnetically attachable bracket to prevent the dislocation of the mandrel unit by buoyancy and other forces during the curing process.

BRIEF DESCRIPTION OF THE DRAWINGS

FIG. 3 is a cross sectional view of the magnet assembly as shown in FIG. 1, according to the preferred embodiments of the invention.

FIG. 4 is an expanded view of the plurality of magnets of the magnet assembly of FIG. 1, according to the preferred embodiments of the current invention.

DETAILED DESCRIPTION OF THE DRAWINGS AND THE PREFERRED EMBODIMENTS THEREIN

Figure 1:
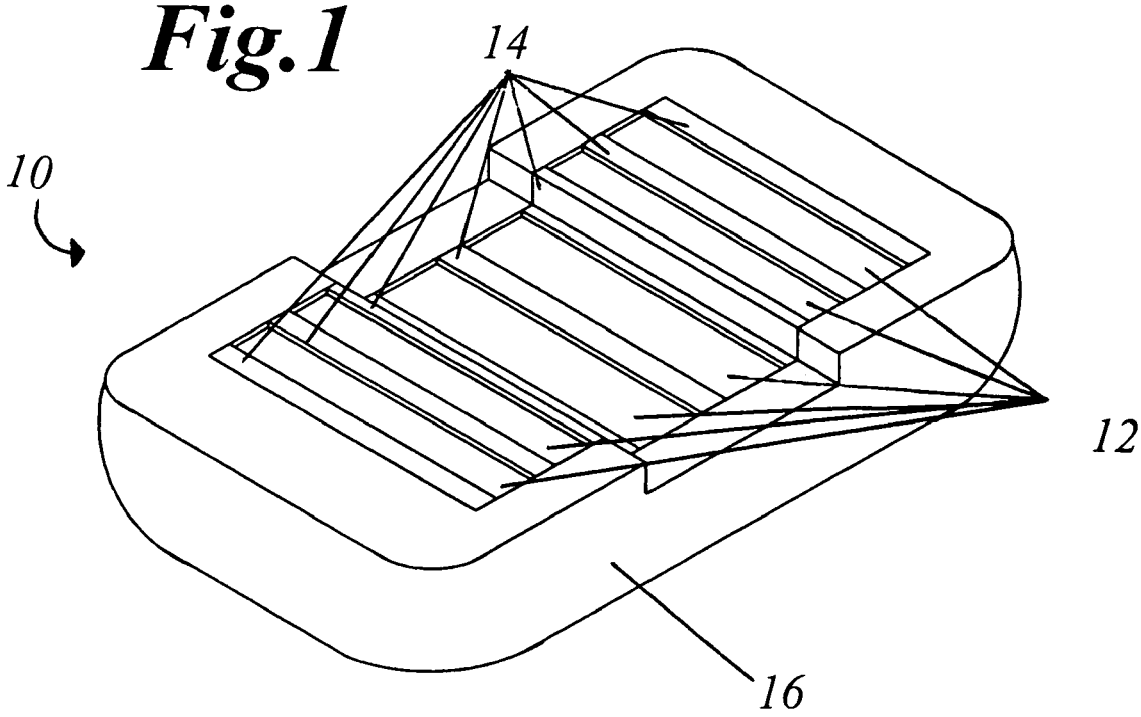
FIG. 1 is a perspective view of the magnet assembly according to the embodiments of the current invention.
Figure 2:
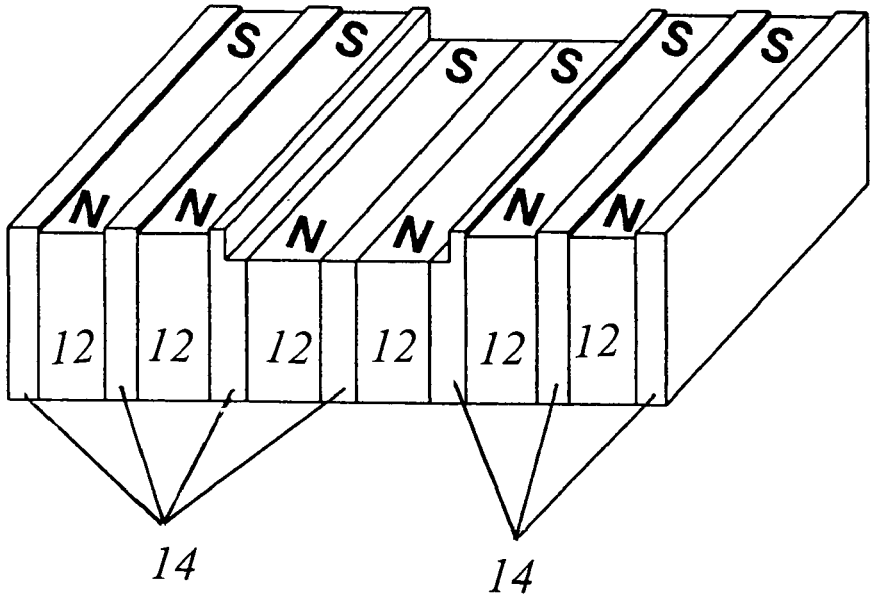
FIG. 2 is a cross sectional view of the magnet assembly as shown in FIG. 1, according to the preferred embodiments of the invention.
Figure 5:
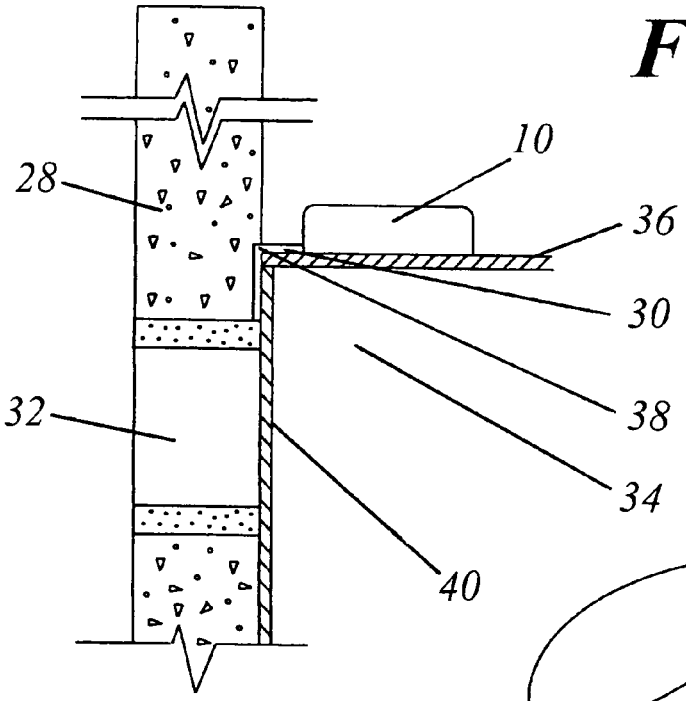
FIG. 5 is a perspective view of the current invention as employed in a cast mold.
Figure 6:
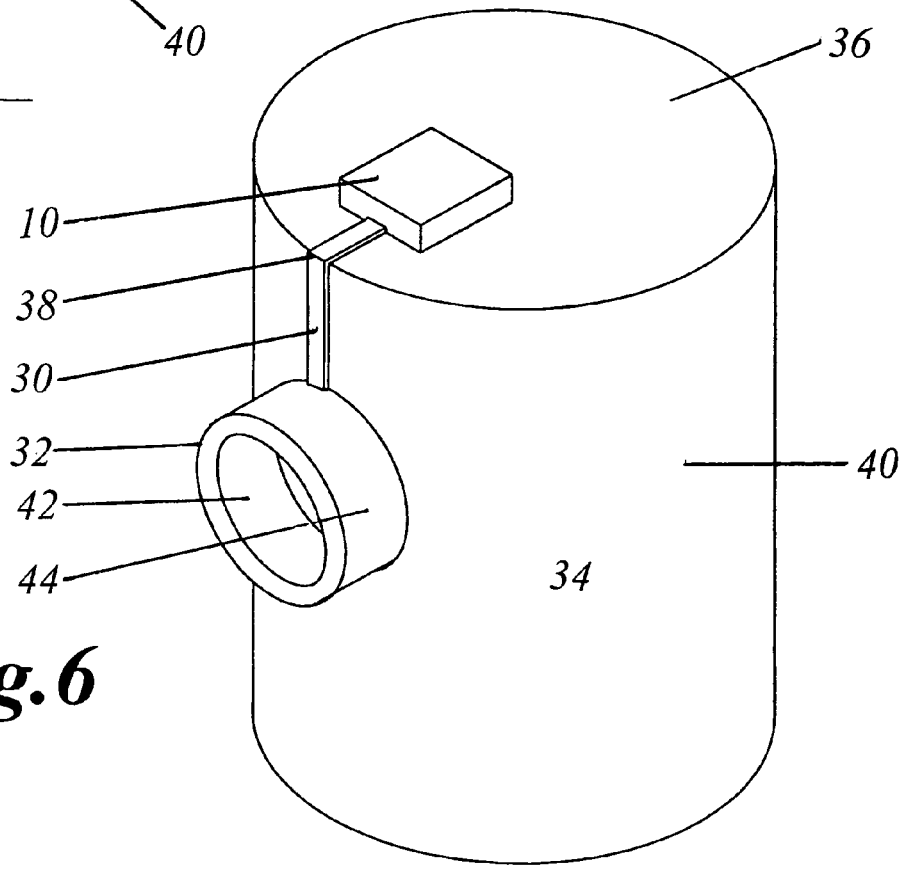
FIG. 6 is a cross-sectional view of the current invention according to the preferred embodiments of the invention.

The device of the current invention is capable of use with a variety of hole and void forming molds, such as hole formers, mandrels, and knock-outs. However, for purposes of the description herein, these and other devices that can be used in mold casting will be collectively referred to as "hole formers." This lexicography should not be seen as limiting the application of the invention to a sole embodiment.

Rather, a "hole former" as used in this section refers to any insert to be used in mold casting that would form a hole or void in the final cast member.

Although the hole former is pictured as cylindrical, one skilled in the art would recognize that a hole former can take a variety of different shapes depending on the particular arrangement and eventual pipe attachment that is desired. However, each hole former 32 can be described as having an outer surface 44 and an inner surface 42. The hole former 32 is capped at least at one end with an end cap, while the other end may be left open to provide access to the interior of the hole former. The end cap is preferably contoured in shape to substantially align with the outside of the inner mold form 34 or the inside of the outer mold jacket. If the hole is to be molded all the way through the casting, the opposite end of the hole former 32 should be contoured so that it substantially aligns with the form or jacket wall not matched with the end cap. In other words, the radius of curvature of the contoured ends of the hole former 32 should match the radius of curvature of the surface that it abuts. This prevents the mold material from entering the interior of the hole former 32, thus complicating the removal of the hole former from the hardened casting material 28. In the case of a drainage box however, it should be noted that the hole former end cap and opposite end will be substantially planar, since the radius of curvature for these structures is zero.

The hole former 32 can be made of any suitable plastic, metal, wood, or other material that can be removed from the mold once the casting material 28 has set. The hole former 32 itself is a cylindrically shaped member that may or may not be substantially hollow.

The hole former 32 is provided with an inner hanging support brace. The support brace extends across the diameter of the hole former 32 and attaches to the hole former's inner surface 42. The support brace can be made of any material that is capable of supporting the weight of the hole former 32, such as metal, alloys, wood or plastic. It should be noted that if the hole former 32 is not substantially hollow, the support brace can constitute the whole interior portion of the hole former 32.

A hanging bracket 30 is provided that is attached to the hole former 32. The bracket 30 can be attached by means of a screw, a bolt, a pin insert, or any other means known in the art, so long as it is able to support the weight of the hole former 32. The bracket 30 can attach to the interior or the exterior of the hole former 32. If the bracket 30 is to be attached to the hole former's interior, there can be provided a hole or slot in the hole former 32 through which the bracket 30 can be inserted, in order to gain access to the interior of the hole former 32.

In a preferred embodiment, the hanging bracket 30 fits into a slight recess in the inner mold form. This provides the inner surface of the finished mold with a more uniform and smooth structure. However, the mold form recess is not a necessary aspect of the present invention, and is only presented here as a non-limiting feature.

The hanging bracket 30 extends from the hole former 32 to the edge of the inner mold form's upper surface 36. The bracket 30 is there provided with a first angle 38. This angle 38 first should match the angle that the surface of the inner wall forms at its intersection with the mold's upper surface 36. While in the present embodiment this is a 90-degree angle, this angle can vary, depending on the shape of the upper surface 36 of the mold. While not meant to be a limitation of the present invention, the bracket 30 works optimally when the bracket angle is set at 90 degrees. In this arrangement, the downward force exerted on the hanging bracket 30 by gravity and the upward force exerted by the hole former's buoyancy during casting pushes entirely against either the upper surface 36, or the magnet assembly 10. At angles other than 90 degrees, buoyancy and gravitational forces would have a vector component that might tend to displace the hole former from its set position in the casting mold.

The bracket 30 extends onto the upper surface 36 of the mold, where a magnet assembly 10 holds the bracket 30 in its predetermined position. The magnet assembly 10 provides a resistant force that prevents any movement of the bracket 30. and therefore also the hole former, during the casting process. Preferably, the magnet assembly 10 is provided with a recess, which is substantially the same depth as the thickness of the hanging bracket 30 with which it interfaces. This allows the bracket 30 to align with the bottom edge of the magnet assembly 10, maximizing the retaining force that the magnet exerts on the bracket 30.

The magnet assembly 10 itself is preferably comprised of a plurality of magnets 12, although any magnet assembly 10 that is capable of retaining the hole former in a stationary location can be used. The plurality of magnets 12 should be arranged in a polar configuration that projects the strongest magnetic field away from the lengthwise surface of the magnets. This should be done in a North to North and South to South arrangement. In this way, the magnetic field generated by each of the magnets is summed together, creating a stronger magnet field that is exerted through the planar surface of the magnet assembly 10. This arrangement thus creates a magnetic field that is stronger than a similarly situated single magnet. The magnets can be made from any magnetic material, including but not limited to ceramic ferrite, samarium-cobalt, neodymium-iron-boron.

Disposed between the magnets are pole pieces 14 that help to direct the flux of the magnets through the planar face of the magnet assembly 10. This produces a stronger magnetic attraction then could be achieved without the pole pieces 14. This pole piece material can be any material that is known in the art, and should not be seen as a limiting feature of the invention. However, for purposes of completeness, the preferred embodiment utilizes a carbon steel material disposed between the magnets. This material increases the additive strength of the separate magnets and directs the summed magnetic field through the planar surface of the abutted magnets. This allows a smaller magnet to oppose the gravitational and buoyant forces acting on the hole former 32 during the casting process. The magnet assembly 10 is therefore better able to retain the hole former 32 and the hanging bracket 30 in its stationary predetermined position.

As shown in FIG. 4, the individual magnets in the magnet assembly 10 are positioned so that like polarities are adjacent one another, being separated by the pole pieces 14. In order to overcome the repulsive forces that the like poles have on each other, the individual magnets must be bonded to the adjacent pole pieces 14. This can be accomplished by any means known in the art, however for purposes of completeness, the magnets of the present embodiment are bonded to the pole pieces 14 with an epoxy. In another embodiment, the magnets and the pole pieces 14 can be held together by the metal casing 16, either by compressive force, or by the use of a cast in ridge, described infra.

The magnet casing 16 can be made from any material that is capable of retaining the disposed magnets, including metals, alloys, and plastics. The current embodiment utilizes a high-grade aluminum that can either be machined or molded into the desired casing shape. The magnet casing 16 has an interior that is capable of receiving the disposed magnets. When the magnet casing 16 is machined, the inner wall 20 of the magnet casing 16 can be provided an inverse chamfer 22. When the disposed magnets are inserted into the machined casing, an epoxy 24 can be utilized in order to retain the magnets within the casing 16 interior. When an inverse chamfer 22 is provided, the epoxy 24 will fill the chamfered area that is not filled by the magnets. This creates a situation where the magnet/epoxy piece is larger at one end of the chamfered casing than is the opening into the interior of the casing 16. Thus, it is very difficult to remove the magnets from the casing 16 without fracturing the epoxy/magnet bonding.

When the casing 16 is cast molded around the disposed magnets, a magnet groove 26 can be employed along the disposed magnets to aide in the retention of magnets within the casing 16. This groove 26 is located around the perimeter of the disposed magnets, such that the cast material 28 fills the groove 26 during the casting process. Thus, once cast, the disposed magnets are virtually locked into place within the interior of the casing 16. This prevents the unwanted removal of the magnets from the casing 16. While the temperatures that are necessarily employed in the casting of the casing 16 have a detrimental effect on the magnetic strength of the disposed magnets, one of ordinary skill in the art would recognize this and make the necessary adjustments in the magnet size or composition to overcome this.

During the casting process, it is not uncommon for the casing 16 to become embedded in the casting material 28. While it is within the scope of the invention to use the coat the magnet assembly 10 with a releasing agent, an optional feature of the magnet assembly 10 is provided to further ease recovery of the magnet assembly 10. To overcome adhesion to the cast material 28, the casing 16 of the current invention can optionally include a disposable blister pack. This blister pack is an expendable covering that attaches itself to the exterior of the casing 16, thus preventing the casing 16 surface from coming into contact with, and adhering to the cast material 28.

The blister pack can be made from any suitable material, however plastic is preferred. The interior of the blister pack is contoured so that it substantially matches the shape of the outer surface of the magnet casing 16. This minimizes the amount of material need for the blister pack, and also prevents seepage of casting material 28 between the blister pack and the casing 16, which could make removal more difficult. The blister pack can be attached to the exterior of the casing 16 using any means known in the art including tape, glue, brackets and the like. Preferably, the blister pack "snaps" onto the casing 16, and is retained by the blister pack clasping around the body of the casing 16.

When the hole former 32 assembly is properly aligned within the mold assembly, an outer jacket is positioned concentrically around the inner mold. While the current embodiment describes this as a cylindrical shape, one skilled in the art would recognize that other shapes could be used, depending on the final application for the cast member. The outer jacket, similar to the inner mold form 34, can be composed of any acceptable material that is resistant to the casting material 28. Therefore, in the case of concrete casting, the outer jacket could be made of wood, fiberglass, metal, metal alloys, plastic, or any other material that one of ordinary skill in the art would recognize as suitable.

The outer jacket is aligned with the inner mold form 34 and the hole former 32 assembly so that the inner wall of the outer jacket is adjacent and flush with the hollow edge of the hole former assembly. This abutted arrangement of the hole former to the outer jacket is necessary to ensure that the cast hole penetrates the entirety of the cast member. The abutted arrangement also prevents the casting material 28 from flowing into the interior of the hole former 32 assembly, which would make removal of the hole former 32 from the cast member more difficult. When a knock-out assembly is used, the hole former 32 will only abut one of the inner walls or the outer jacket. This is utilized to make a thinner section of cast material 28.

The space between the outer jacket and the inner mold form 34 is filled with casting material 28. When the casting material 28 hardens, the cast is removed from the mold form. The magnet assembly 10, which is embedded in the cast material 28, can then be removed. To facilitate removal of the magnet assembly 10, a metal handle or other magnetically attractable member can be adhered to the magnet assembly 10. The magnetic attraction by the magnet assembly 10 to the metal handle is greater than the adhesive forces between the cast member and the magnet casing 16. One can then simply lift the magnet assembly 10 out of the cast material 28.

When a blister pack is utilized, removal of the magnet assembly 10 becomes even easier. A handle is magnetically adhered to the magnet as above. However, it is not necessary to fracture the casing/casting adhesion. The magnet assembly 10 simply "unsnaps" from the blister pack, leaving the disposable blister pack embedded in the final cast member.

SUMMARY OF THE ACHIEVEMENT OF THE OBJECTS OF THE INVENTION

From the foregoing, it is readily apparent that we have invented a novel apparatus and method for positioning and securing a hole former during a cast molding process. The current invention utilizes a magnetic anchoring assembly placed atop the inner mold form, that holds a bracket. The bracket is aligned horizontally with the outer wall of the inner mold, and attaches to a mandrel. The mandrel defines the hole in the final cast material, which the magnet prevents movement of the mandrel during casting. Additionally, by using brackets of differing lengths or adjusting the bracket/mandrel attachment, the hole former of the current invention can be reused to create holes in differing locations for different cast members without damaging the structure of the mold as does many of the prior art devices. Finally a blister pack can be utilized with the magnetic assembly to facilitate the removal of the magnetic assembly from the cast member.

It is to be understood that the foregoing description and specific embodiments are merely illustrative of the best mode of the invention and the principles thereof, and that various modifications and additions may be made to the apparatus by those skilled in the art, without departing from the spirit and scope of this invention, which is therefore understood to be limited only by the scope of the appended claims.

I claim:

1. A device for positioning a hole former within a casting mold, said casting mold comprising an inner mold form and an outer jacket, said inner mold form further comprising an inner surface and an upper surface, said device comprising:

At least one hole former member that is adapted for secured placement against at least one of said inner surface or outer jacket;

At least one bracket member capable of attachment to said hole former member, said bracket member adapted to substantially abut said inner surface and said upper surface;

At least one magnet assembly, said magnet assembly being adapted to releasably attach said bracket to said upper surface.

2. The device for positioning a hole former of claim 1, wherein said at least one magnet assembly comprises a plurality of magnets, a plurality of pole pieces, and an outer casing.

3. The device for positioning a hole former of claim 2, wherein said outer casing further comprises a cavity, wherein said plurality of magnets are alternatingly disposed with said plurality of pole pieces.

4. The device for positioning a hole former of claim 3, wherein said alternatingly disposed plurality of pole pieces and said altematingly disposed plurality of magnets further comprises a channel that is capable of receiving said bracket member.

5. The device for positioning a hole former of claim 4, wherein said plurality of magnets are constructed of a material selected from a group consisting of ceramic ferrite, samarium-cobalt, neodymium-iron-boron, or a combination thereof.

6. The device for positioning a hole former of claim 4, wherein said pole pieces are constructed of carbon steel.

7. The device for positioning a hole former according to claim 3, wherein said magnet assembly further comprises an epoxy for retaining said altematingly disposed magnets and pole pieces within said cavity.

8. The device for positioning a hole former according to claim 7, wherein said cavity further comprises a chamfered inner wall creating a space between said inner wall and said altematingly disposed magnets and altematingly disposed pole pieces, said space being substantially filled by said epoxy.

9. The device for positioning a hole former according to claim 3, wherein said magnet assembly further comprises a magnet groove that is capable of interfacing with said outer casing.

* * * * *